US008390662B2

(12) United States Patent
Nagamine et al.

(10) Patent No.: US 8,390,662 B2
(45) Date of Patent: Mar. 5, 2013

(54) EXPOSING DEVICE HAVING LIGHT EMITTING ELEMENTS AND IMAGE FORMING APPARATUS USING THE SAME

(75) Inventors: Masamitsu Nagamine, Takasaki (JP); Takao Sakai, Takasaki (JP)

(73) Assignee: Oki Data Corporation, Tokyo (JP)

( * ) Notice: Subject to any disclaimer, the term of this patent is extended or adjusted under 35 U.S.C. 154(b) by 164 days.

(21) Appl. No.: 12/907,106

(22) Filed: Oct. 19, 2010

(65) Prior Publication Data

US 2011/0096133 A1 Apr. 28, 2011

(30) Foreign Application Priority Data

Oct. 23, 2009 (JP) ..... 2009-244566

(51) Int. Cl.
*B41J 15/14* (2006.01)
*B41J 27/00* (2006.01)

(52) U.S. Cl. ..... 347/242; 347/257

(58) Field of Classification Search ..... 347/230, 347/238, 241–245, 256–258, 263
See application file for complete search history.

(56) References Cited

U.S. PATENT DOCUMENTS 6,025,863 A * 2/2000 Nakajima et al. ..... 347/238
6,169,564 B1 * 1/2001 Tsukagoshi et al. ..... 347/238
7,760,224 B2 * 7/2010 Nagamine ..... 347/238

FOREIGN PATENT DOCUMENTS

JP 2002067374 A * 3/2002
JP 2002-154235 A 5/2002

* cited by examiner

*Primary Examiner* — Hai C Pham
(74) *Attorney, Agent, or Firm* — Panitch Schwarze Belisario & Nadel LLP

(57) ABSTRACT

An exposing device includes a plurality of light emitting elements, a substrate to which the plurality of light emitting elements are mounted, an optical system that focuses lights emitted by the plurality of light emitting elements, and a holder that holds the optical system. The holder has a substrate abutting surface that abuts against the substrate. The holder includes a base material portion made of metal, and a substrate abutting portion formed integrally with the base material portion. The substrate abutting portion is made of resin having electrical insulation property. The surface abutting surface is formed on the surface abutting portion.

11 Claims, 14 Drawing Sheets

353
S1
S1
S1

EXPOSING DEVICE HAVING LIGHT EMITTING ELEMENTS AND IMAGE FORMING APPARATUS USING THE SAME

BACKGROUND OF THE INVENTION

The present invention relates to an exposing device and an image forming apparatus using the exposing device.

A general electrophotographic image forming apparatus (for example, a printer, a copier, a facsimile machine or a combined machine) uses an exposing device such as an LED head that exposes a uniformly charged surface of a photosensitive drum to form a latent image.

The exposing device includes, for example, an LED array mounted to a substrate and a rod lens array held by a lens holder. The substrate is mounted to the lens holder so that the LED array faces the rod lens array. The surface of the photosensitive drum is located on a focusing position of the rod lens array. Lights emitted by the LED array pass the rod lens array, and are focused on the surface of the photosensitive drum to form a latent image.

Since the lens holder has a function to support the substrate and the lens array, the lens holder is generally made of aluminum having rigidity (see, for example, Patent Document No. 1). Further, the lens holder has substrate abutting surfaces which are finished with high accuracy. The substrate is held by the lens holder in such a manner that both end portions of the substrate (in a widthwise direction thereof) contact the substrate abutting surfaces.

Patent Document No. 1: Japanese Laid-open Patent Publication No. 2002-154235 (paragraph 0006, FIG. 1)

In this regard, there is a need for a technique capable of ensuring electrical insulation between the substrate and the lens holder made of metal.

SUMMARY OF THE INVENTION

The present invention is intended to provide an exposing device and an image forming apparatus capable of ensuring electrical insulation of a substrate on which light emitting elements are formed.

The present invention provides an exposing device including a plurality of light emitting elements, a substrate to which the plurality of light emitting elements are mounted, an optical system that focuses lights emitted by the plurality of light emitting elements, and a holder that holds the optical system. The holder has a substrate abutting surface that abuts against the substrate. The holder includes a base material portion made of metal, and a substrate abutting portion formed integrally with the base material portion. The substrate abutting portion is made of resin having electrical insulation property. The surface abutting surface is formed on the surface abutting portion.

With such a configuration, rigidity of the holder is ensured by the base material portion made of metal, and insulation between the holder and the substrate is ensured by the substrate abutting portion made of resin having electrical insulation property.

The present invention also provides an image forming apparatus including the above described exposing device and a latent image bearing body exposed by the exposing device to form a latent image thereon.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The drawings are provided for purposes of explanation only and do not limit the scope of this invention.

First Embodiment

Figure 1:
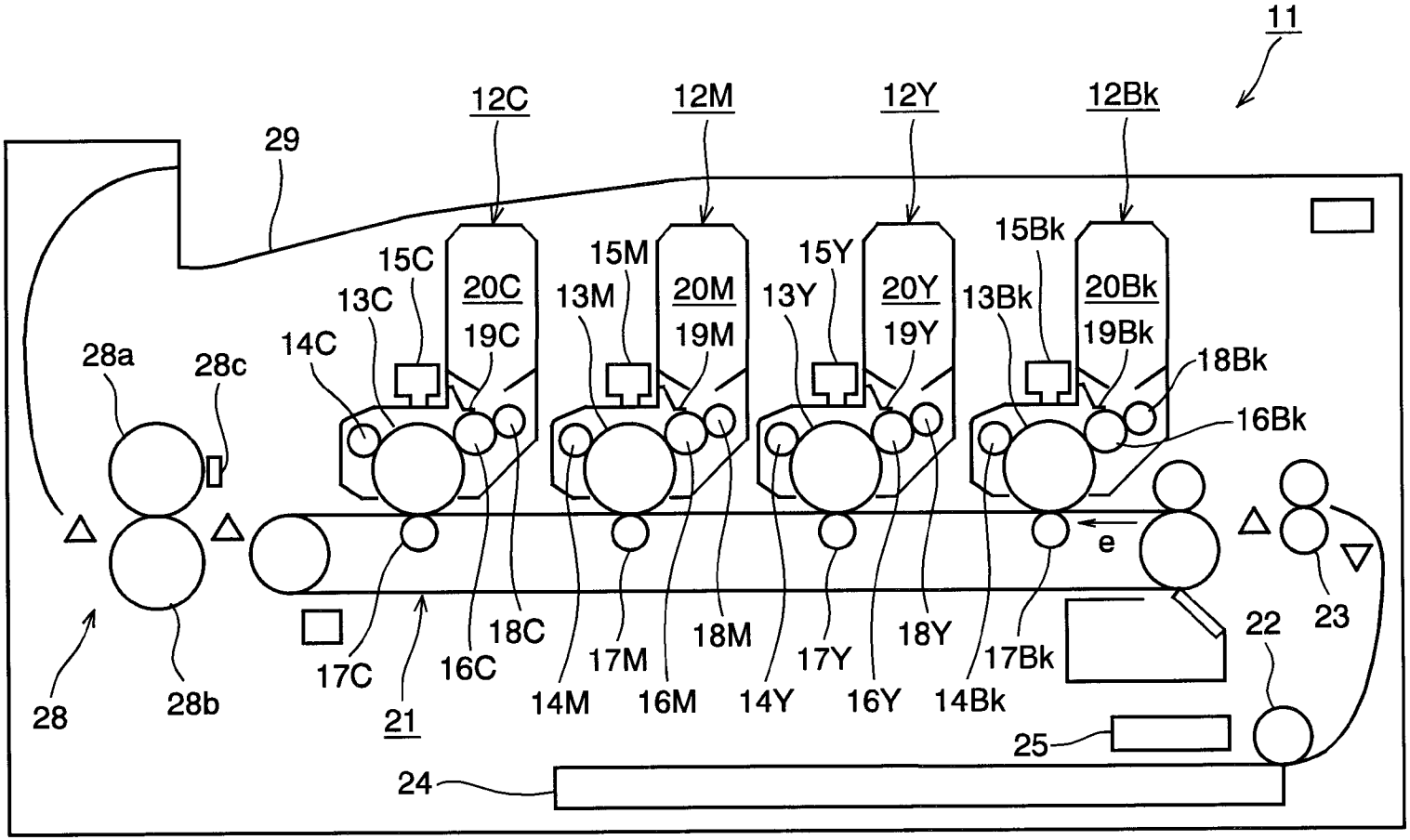
FIG. 1 is a schematic view showing a configuration of an image forming apparatus according to the first embodiment of the present invention.

FIG. 1 is a schematic view showing a configuration of a printer 11 as an image forming apparatus according to the first embodiment of the present invention.

As shown in FIG. 1, the printer 11 includes four image forming units 12Bk, 12Y, 12M and 12C (also referred to as process devices) that respectively form images of black (Bk), yellow (Y), magenta (M) and cyan (C). The image forming units 12Bk, 12Y, 12M and 12C are arranged along a feeding path of a printing sheet (i.e., a medium) from an upstream side to a downstream side (i.e., from the right to the left in FIG. 1).

As to the medium, it is also possible to use an OHP sheet, an envelope, a copy sheet or a special sheet or the like.

The image forming units 12Bk, 12Y, 12M and 12C include photosensitive drums 13Bk, 13Y, 13M and 130 as latent image bearing bodies, charging rollers 14Bk, 14Y, 14M and 14C as charging devices that uniformly charge the surfaces of the photosensitive drums 13Bk, 13Y, 13M and 13C, and developing rollers 16Bk, 16Y, 16M and 16C as developer bearing bodies that develop latent images on the photosensitive drums 13Bk, 13Y, 13M and 13C using toners (i.e., developers) of respective colors to form toner images (i.e., developer images).

Toner supplying rollers 18Bk, 18Y, 18M and 18C as developer supplying members are provided so as to contact the developing rollers 16Bk, 16Y, 16M and 16C to supply the toners to the developing rollers 16Bk, 16Y, 16M and 16C. Further, developing blades 19Bk, 19Y, 19M and 19C as developer regulating members are provided so as to contact the developing rollers 16Bk, 16Y, 16M and 16C to regulate thicknesses of toner layers formed on the surfaces of the developing rollers 16Bk, 16Y, 16M and 16C. Toner cartridges 20Bk, 20Y, 20M and 20C are detachably provided above the toner supplying rollers 18Bk, 18Y, 18M and 180 to supply toners to the image forming units 12Bk, 12Y, 12M and 12C.

LED heads 15Bk, 15Y, 15M and 15C are provided so as to face the photosensitive drums 13Bk, 13Y, 13M and 130 of the image forming units 12Bk, 12Y, 12M and 12C. The LED heads 15Bk, 15Y, 15M and 15C expose the surfaces of the photosensitive drums 13Bk, 13Y, 13M and 13C based on image data of respective colors so as to form latent images.

A transfer unit is provided below the image forming units 12Bk, 12Y, 12M and 12C. The transfer unit includes a feeding belt 21 as a feeding member that absorbs the printing sheet and feeds the printing sheet along the image forming units 12Bk, 12Y, 12M and 12C. The transfer unit further includes transfer rollers 17Bk, 17Y, 17M and 17C as transfer members provided so as to face the photosensitive drums 13Bk, 13Y, 13M and 13C via the feeding belt 21. The feeding belt 21 and the transfer rollers 17Bk, 17Y, 17M and 17C charge the printing sheet to a polarity opposite to the toner, so as to transfer the toner images from the photosensitive drums 13Bk, 13Y, 13M and 13C to the printing sheet.

A fixing device 28 is provided on a downstream side (i.e., left in FIG. 1) of the image forming units 12Bk, 12Y, 12M and 12C. The fixing device 28 includes a fixing roller 28*a* and a pressure roller 28*b* that fix the toner image to the printing sheet by application of heat and pressure. The fixing device 28 further includes a temperature sensor 28*c* for detecting a surface temperature of the fixing roller 28*a*.

A sheet feeding mechanism is provided on a lower part of the printer 11 for feeding the printing sheets to the feeding path. The sheet feeding mechanism include a sheet cassette 24 as a medium storing portion for storing the printing sheets therein, a hopping roller 22 that feeds the printing sheets one by one from the sheet cassette 24, and a registration roller 23 that conveys the printing sheet to the feeding belt 21. A sheet color detection unit 25 is provided for detecting a color of the sheet stored in the sheet cassette 24.

Next, an operation of the printer 11 will be described.

First, the hopping roller 22 feeds the printing sheet out of the sheet cassette 24, and then the registration roller 23 conveys the printing sheet to the feeding belt 21. The feeding belt 21 absorbs the printing sheet and moves in a direction indicated by an arrow "e". The LED heads 15Bk, 15Y, 15M and 15C expose the photosensitive drums 13Bk, 13Y, 13M and 13C of the image forming units 12Bk, 12Y, 12M and 12C to form latent images thereon. The developing rollers 16Bk, 16Y, 16M and 16C develop the latent images to form toner images of the respective colors.

As the feeding belt 21 feeds the printing sheet through between the image forming units 12Bk, 12Y, 12M and 12C and the transfer rollers 17Bk, 17Y, 17M and 17C, the toner images of the respective colors are transferred from the photosensitive drums 13Bk, 13Y, 13M and 13C to the printing sheet.

The printing sheet is fed to the fixing device 28. In the fixing device 28, the printing sheet is heated and pressed by the fixing roller 28*a* and the pressure roller 28*b*, so that the toner is molten and fixed to the printing sheet. As a result, a color toner image is fixed to the printing sheet. The printing sheet to which the toner image is fixed is ejected outside the printer 11, and is placed on a stacker 19 provided on an upper part of the printer 11.

Next, relationship between the photosensitive drums 13Bk, 13Y, 13M and 13C and the LED heads 15Bk, 15Y, 15M and 15C will be described. The photosensitive drums 133*k*, 13Y, 13M and 13C have the same configuration, and therefore the photosensitive drums 13Bk, 13Y, 13M and 13C will be collectively referred to as "the photosensitive drum 13". The LED heads 15Bk, 15Y, 15M and 15C have the same configuration, and therefore the LED heads 15Bk, 15Y, 15M and 15C will be collectively referred to as "the LED head 15".

Figure 2:
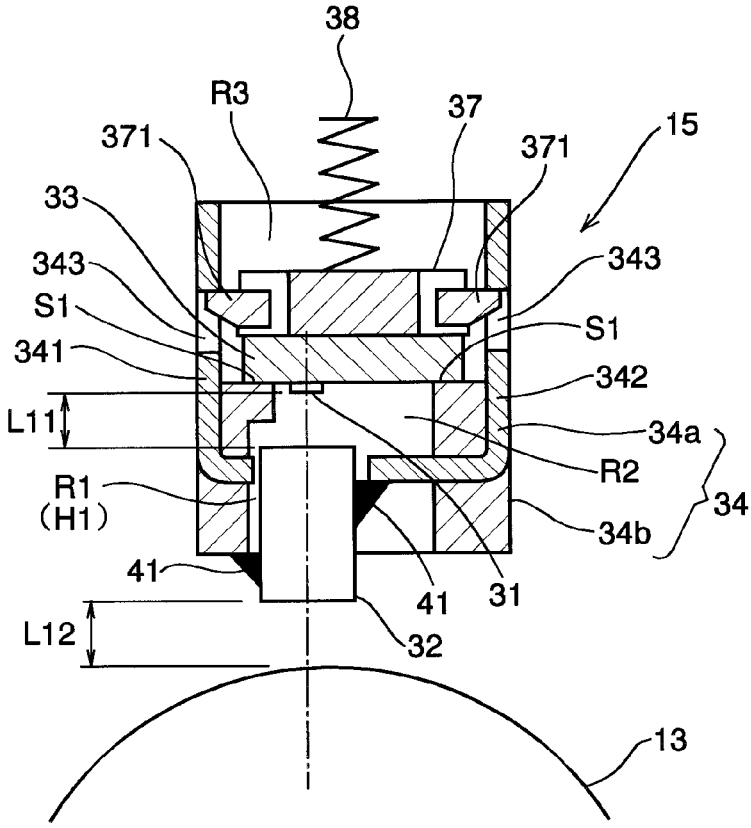
FIG. 2 is a cross sectional view showing an LED head according to the first embodiment of the present invention.
Figure 3:
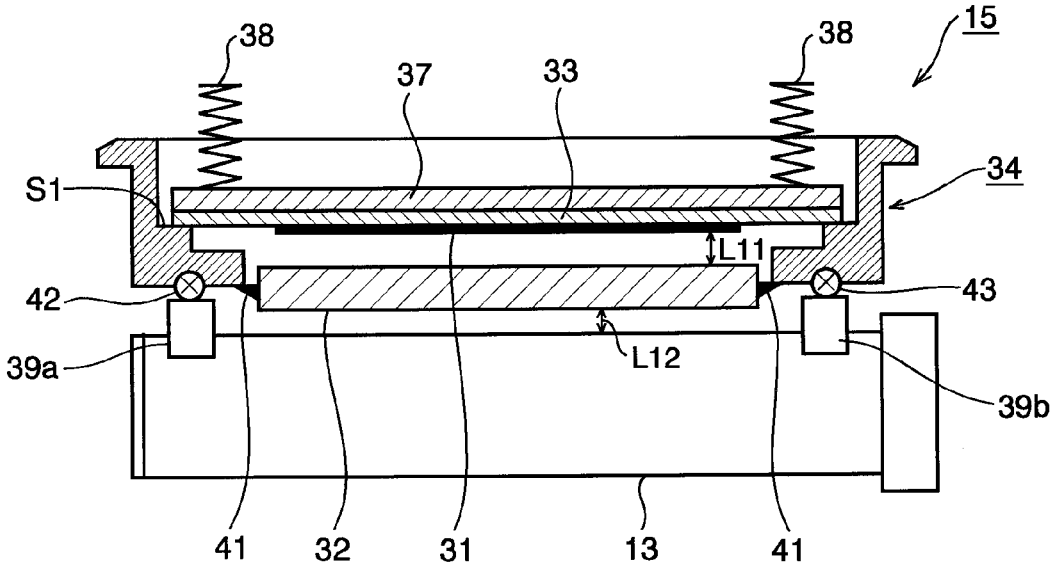
FIG. 3 is a longitudinal sectional view showing the LED head according to the first embodiment of the present invention.

FIGS. 2 and 3 are a cross sectional view and a longitudinal sectional view showing the LED head 15 and the photosensitive drum 13 according to the first embodiment of the present invention. As shown in FIG. 2, the LED head 15 includes an LED array chip 31 and a rod lens array 32. The LED array chip 31 includes a plurality of LEDs (i.e., light emitting elements) provided so as to face the photosensitive drum 13. The LEDs are arranged in an axial direction of the photosensitive drum 13. The rod lens array 32 includes a plurality of lens elements that focus the lights emitted by the LEDs onto the surface of the photosensitive drum 13. Further, the LED head 15 includes a substrate 33 on which the LED array chip 31 is mounted. A driver IC (not shown) for controlling the LED array chip 31 is also mounted to the substrate 33. The LED head 15 further includes a lens holder 34 (as a holder) that holds the rod lens array 32. The rod lens array 32 is fixed to the lens holder 34. Further, the substrate 33 is mounted to the lens holder 34. The lens holder 34 is integrally formed using different kinds of materials as described later.

The lens holder 34 has an inner space extending from a bottom of the lens holder 34 (facing the photosensitive drum 13) to a top of the lens holder 34. The inner space includes a first region R1, a second region R2 and a third region R3 arranged in this order from the bottom. The first region R1 is a space for storing the rod lens array 32. The second region R2 is formed above the first region R1 so as to be connected to the first region R1. The third region R3 is formed above the second region R2 so as to be connected to the second region R2. The third region R3 is wider than the second region R2. Substrate abutting surfaces S1 are formed on step portions at a border between the second region R2 and the third region R3. The substrate abutting surfaces S1 are aligned on a same plane defining the position of the substrate 33 (on which the LED array chip 31 is mounted) with respect to the rod lens array 32 and the photosensitive drum 13.

The substrate 33 is inserted into the third region R3 of the lens holder 34 from above, and is held in the third region R3 in such a manner that a bottom surface (more specifically, both ends in a widthwise direction) of the substrate 33 abuts against the substrate abutting surfaces S1. A pushing member 37 is provided on the substrate 33 for pushing the substrate 33 against the substrate abutting surfaces S1. The pushing member 37 is biased in a direction toward the substrate abutting surface S1 by a coil spring 38 as a biasing member. With a resilient force of the coil spring 38, the pushing member 37 pushes the substrate 33 against the substrate abutting surfaces S1.

The rod lens array 32 is fixed (bonded) to the lens holder 34 in the first region R1. A gap between the rod lens array 32 and the first region R1 of the lens holder 34 is sealed with a seal member 41 made of silicone, in order to prevent entry of light and debris into the inner space of the lens holder 34.

Here, in order to accurately focus the lights onto the surface of the photosensitive drum 13, it is necessary that a distance L11 from the surface of the LED array chip and an incident surface of the rod lens array 32 is substantially the same as a distance L12 from an exit surface of the rod lens array 32 to the surface of the photosensitive drum 13. Therefore, the distance L12 needs to be adjusted so that the distance L11 and the distance L12 are the same as each other (L11=L12).

For this purpose, as shown in FIG. 3, eccentric cam mechanisms 42 and 43 as adjusting mechanisms are provided in the vicinities of both ends of the lens holder 34 in the longitudinal direction. The eccentric cam mechanisms 42 and 43 abut against spacers 39*a* and 39*b* provided so as to contact the surface of the photosensitive drum 13 in the vicinities of both ends the photosensitive drum 13 in the longitudinal direction. Further, the above described coil springs 38 are provided in the vicinities of both ends the pushing member 37 in the longitudinal direction. The coil springs 38 push the lens holder 34 toward the photosensitive drum 13 (i.e., downward in FIG. 3), so that the eccentric cam mechanisms 42 and 43 abut against the spacers 39*a* and 39*b*. By adjusting the eccentric cam mechanisms 42 and 43, the distance L2 can be adjusted to be the same as the distance L1 throughout the length of the lens holder 34.

Figure 4:
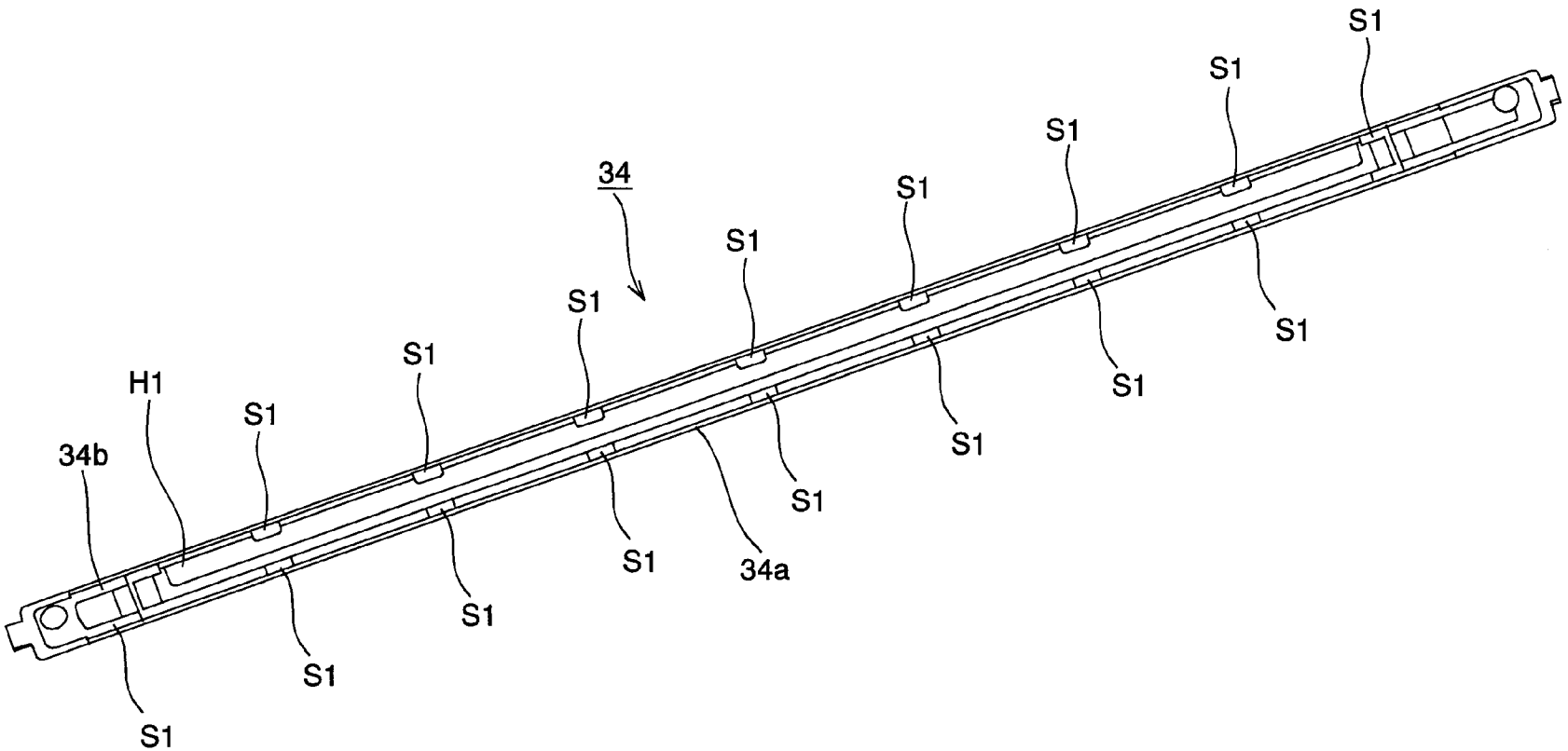
FIG. 4 is a plan view showing a lens holder of the LED head according to the first embodiment of the present invention.
Figure 5:
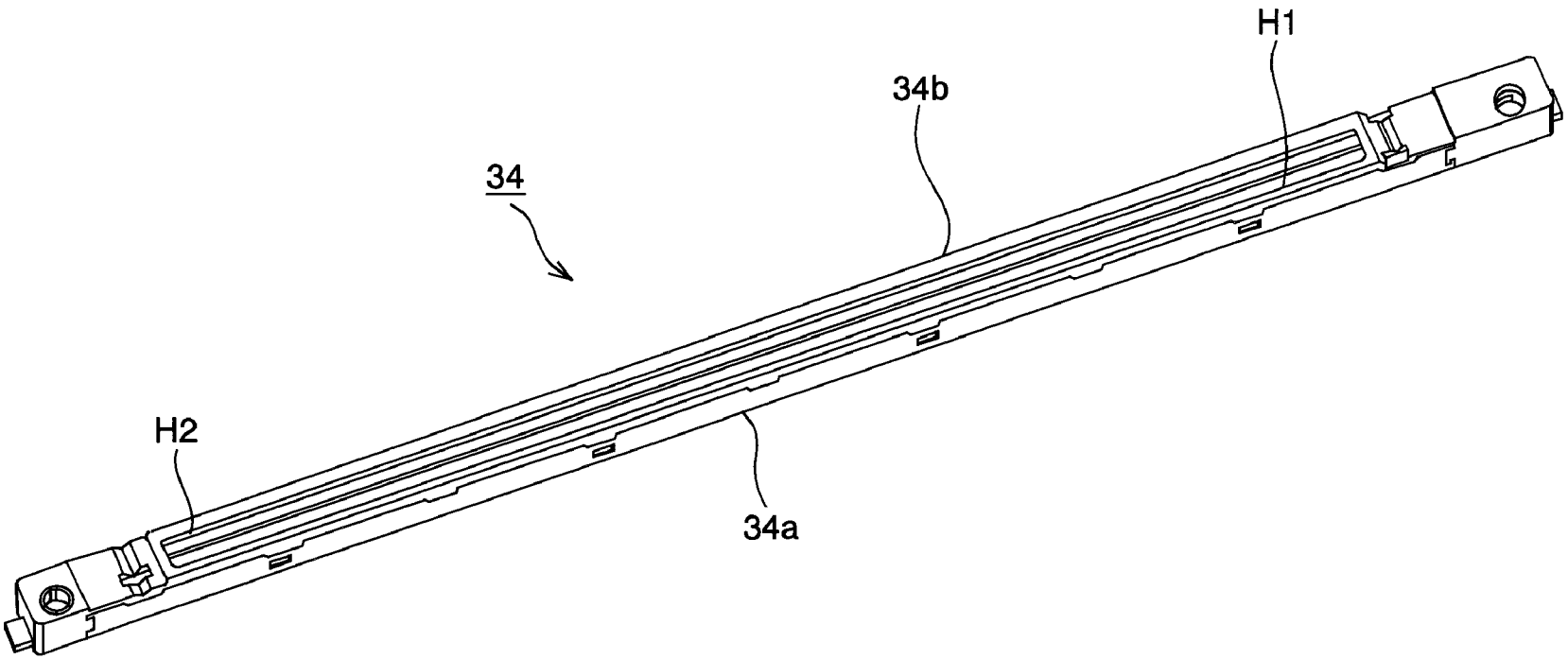
FIG. 5 is a bottom perspective view showing the lens holder according to the first embodiment of the present invention.
Figure 6:
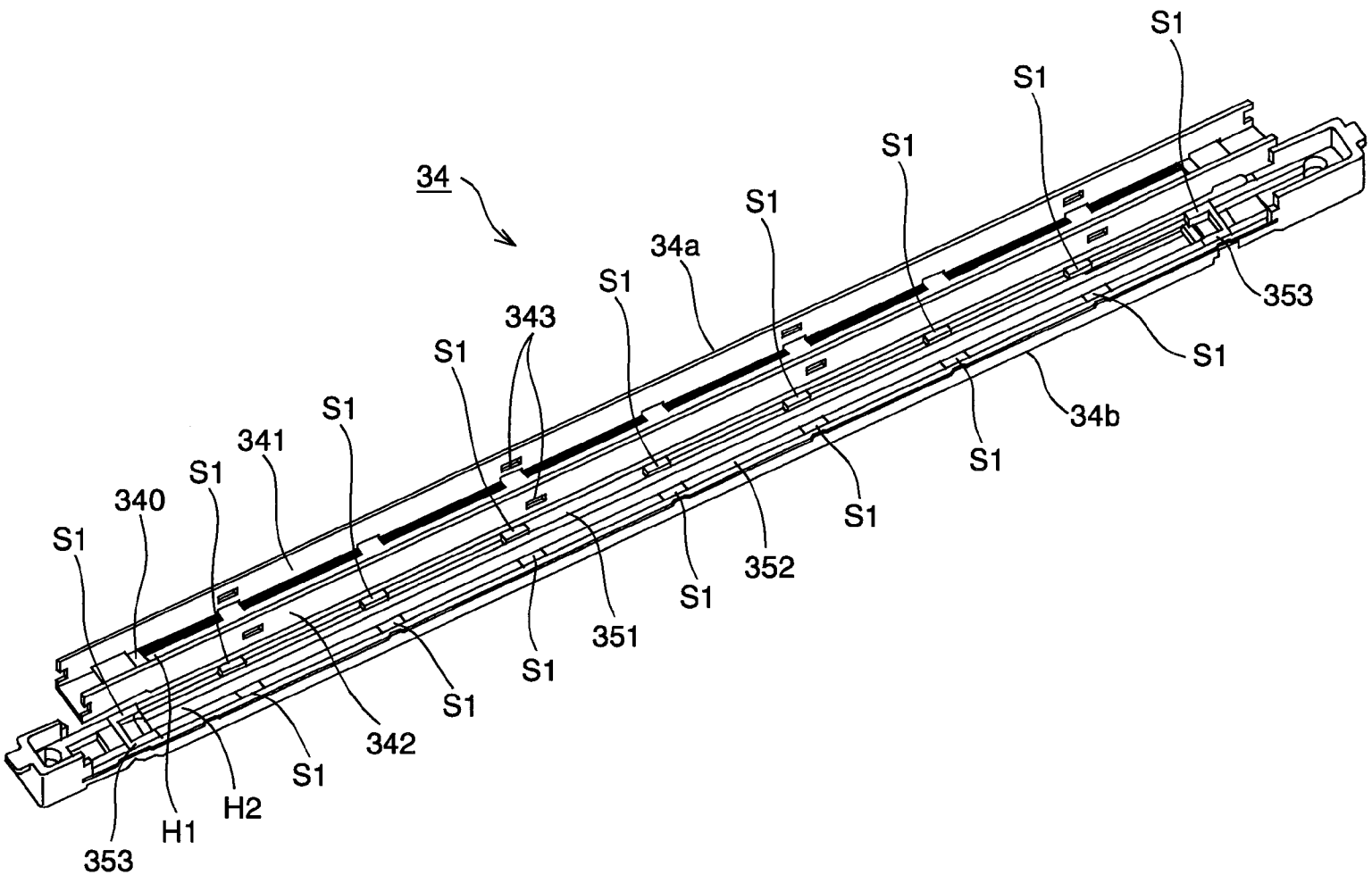
FIG. 6 is an upper exploded perspective view showing the lens holder according to the first embodiment of the present invention.
Figure 7:
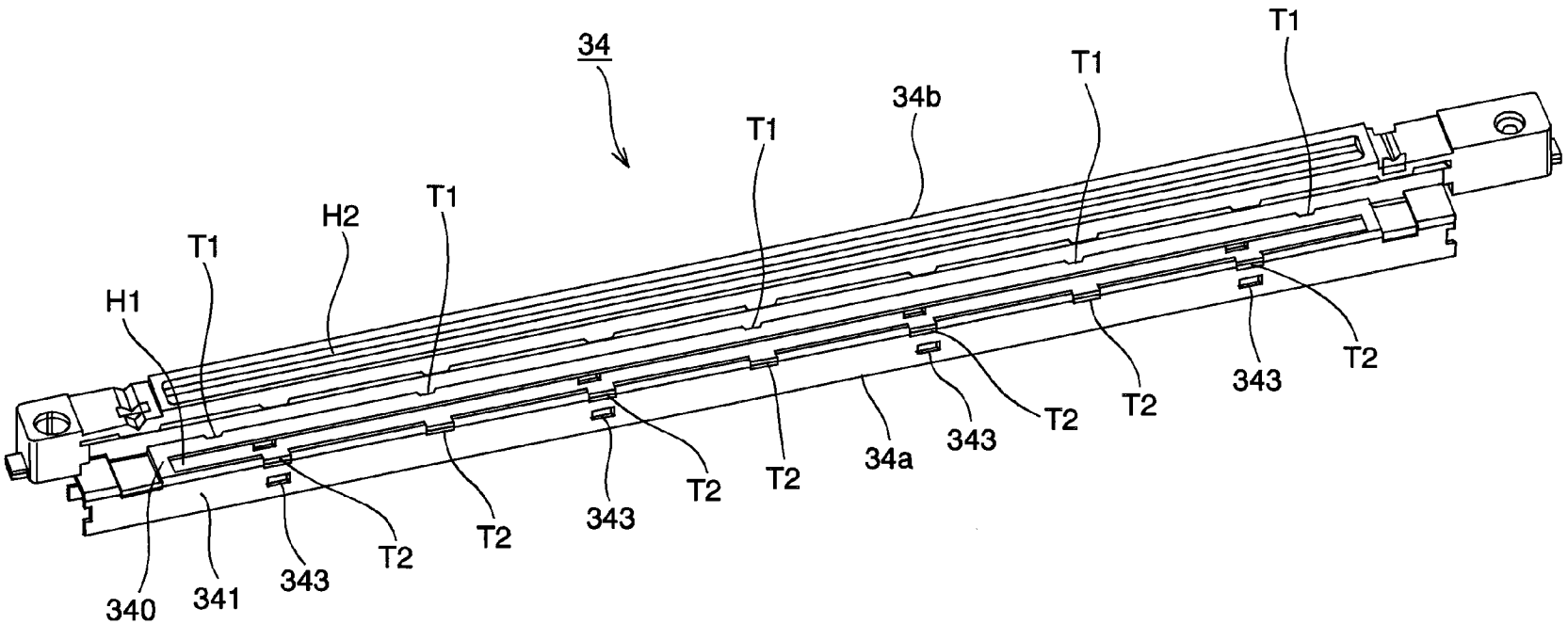
FIG. 7 is a bottom exploded perspective view showing the lens holder according to the first embodiment of the present invention.
Figure 8:
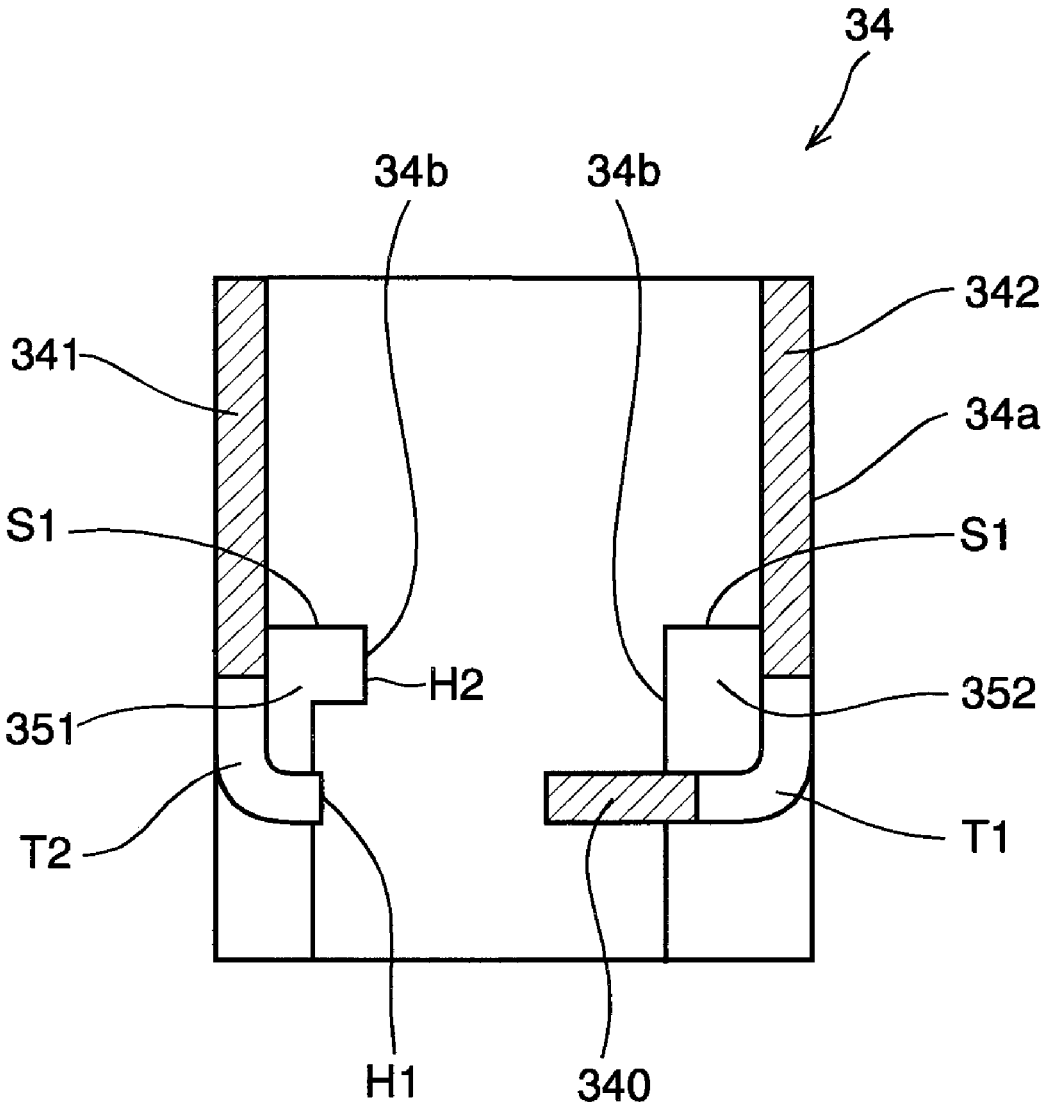
FIG. 8 is a cross sectional view showing the lens holder according to the first embodiment of the present invention.

FIG. 4 is a plan view showing the lens holder 34 according to the first embodiment of the present invention. FIG. 5 is a bottom perspective view showing the lens holder 34 according to the first embodiment of the present invention. FIGS. 6 and 7 are an upper exploded perspective view and a bottom exploded perspective view showing the lens holder 34 according to the first embodiment of the present invention. FIG. 8 is a cross sectional view (cut by a plane perpendicular to the longitudinal direction) of the lens holder 34 according to the first embodiment of the present invention.

As shown in FIGS. 4 through 7, the lens holder 34 includes a substrate abutting portion 34*b* having the substrate abutting surfaces S1, and a base material portion 34*a* that acts as a frame. The base material portion 34*a* constitutes a body of the lens holder 34. The base material portion 34*a* is made of metal (more specifically, a metal plate). The substrate abutting portion 34*b* with the substrate abutting surfaces S1 is made of resin having electrical insulation property. The substrate abutting portion 34*b* is preferably made of thermoplastic resin. The substrate abutting portion 34*b* is more preferably made of engineering plastic (for example, general-purpose engineering plastic). The lens holder 34 is integrally formed using a combination of different kinds of materials, i.e., the base material portion 34*a* made of metal and the substrate abutting portion 34*b* made of resin (i.e., thermoplastic resin).

To be more specific, the lens holder 34 is formed using an outsert forming method. In the outsert forming method, a metal plate (as the base material portion 34*a*) is placed in a cavity of a mold, and then a molten resin (having electrical insulation property) is poured into the mold, with the result that the substrate abutting portion 34*b* (resin) is formed integrally with the base material portion 34*a* (metal) to form the lens holder 34.

In this regard, the base material portion 34*a* and the substrate abutting portion 34*b* are shown separately from each other in exploded perspective views of FIGS. 6 and 7 for the purpose of clearly showing the respective shapes of the base material portion 34*a* and the substrate abutting portion 34*b*. However, the base material portion 34*a* and the substrate abutting portion 34*b* are integrally formed as described above.

As shown in FIG. 6, the base material portion 34*a* of the metal plate has an elongated shape. In a cross section perpendicular to the longitudinal direction of the base material portion 34*a*, the base material portion 34*a* has a substantially rectangular U shape, and has a bottom plate 340 and a pair of side walls 341 and 342. The bottom plate 340 of the base material portion 34*a* has an elongated hole H1 (i.e., an elongated opening) for storing the rod lens array 32 therein. The elongated hole H1 corresponds to the first region R1 shown in FIG. 2. The elongated hole H1 disposed on a shifted position (shifted toward the side wall 341) with respect to a center line of the base material portion 34*a* in the widthwise direction. Further, the elongated hole H1 extends substantially throughout the length of the base material portion 34*a* (except both ends in the longitudinal direction). Guide holes 343 are formed on the side walls 341 and 342, which engage protrusions 371 (FIG. 2) on both sides of the pushing member 37 so as to regulate a movable range of the pushing member 37.

The substrate abutting portion 34*b* has an elongated shape. Further, the substrate abutting portion 34*b* is formed so as to surround the elongated hole H1 of the base material portion 34*a*. That is, the substrate abutting portion 34*b* has an elongated hole H2 having a longer length and a wider width than the elongated hole H1, and further has extending portions 351 and 352 extending linearly along the elongated hole H2 on both sides of the elongated hole H2. A plurality of the substrate abutting surfaces S1 are formed on each of the extending portions 351 and 352 at predetermined intervals. Each of the substrate abutting surfaces S1 has a rectangular shape. The substrate abutting surfaces S1 are also formed on end portions 353 (of rectangular U shapes) adjacent to both ends of the elongated hole H2 in the longitudinal direction. A space between the extending portions 351 and 352 of the substrate abutting portion 34*b* corresponds to the region R2 shown in FIG. 2.

As shown in FIG. 8, holes T1 are formed on a side (i.e., right in FIG. 8) of the base material portion 34*a* in the widthwise direction, and cutout portions T2 are formed on the other side (i.e., left in FIG. 8) of the base material portion 34*a* in the widthwise direction. The holes T1 are formed on corners between the bottom plate 340 and the side wall 342. The cutout portions T2 are formed on corners of the bottom plate 340 and the side wall 341. The cutout portions T2 are connected to the elongated hole H1, but the holes T1 are not connected to the elongated hole H1. As shown in FIG. 7, the holes T1 and the cutout portions T2 are arranged along the longitudinal direction of the base material portion 34*a*.

The substrate abutting portion 34*b* is formed using the described outsert forming method by causing the molten resin (for example, thermoplastic resin) to flow via the holes T1 and the cutout portions T2 of the base material portion 34*a* (i.e., the metal plate) in the mold. With such a method, the substrate abutting portion 34*b* is formed integrally with the base material portion 34*a* so that the substrate abutting portion 34*b* sandwiches a part (more specifically, a part including the bottom plate 340) of the base material portion 34*a* from above and from below (i.e., two opposing sides).

Since the LED array chip 31 is mounted to the substrate 33, the substrate 33 is required to have linearity in the longitudinal direction of the substrate (i.e., an arranging direction the LEDs). For this purpose, the lens holder 34 is required to have rigidity, and the substrate abutting surface S1 of the substrate abutting portion 34*b* is required to have high flatness. This is because it is necessary that the distance L11 from the surface of the LED array chip 31 to the incident surface of the rod lens array 32 is substantially the same as the distance L12 from the exit surface of the rod lens array 32 to the surface of the photosensitive drum 13 (i.e., L11=L12), in order to accurately focus the lights onto the surface of the photosensitive drum 13. Further, if the substrate abutting surfaces S1 of the lens holder 34 are undulated, the LED array chip 31 is also undulated following the substrate abutting surfaces S1, and therefore the lights emitted by the LED array chip 31 are not accurately focused onto the surface of the photosensitive drum 13. In other words, a linear image is not accurately formed.

In order to obtain excellent printing quality, an allowable range of a straightness of the linear image formed on the surface of the photosensitive drum 13 (by the lights emitted from the LED array chip 31 via the rod lens array 32) is ±50 μm. For example, when the flatness of the substrate abutting surface S1 of the lens holder 34 is ±30 μm and the straightness of the rod lens array 32 is ±10 μm, the straightness of the linear, image formed on the surface of the photosensitive drum 13 is ±40 μm which is within the allowable range, so that an excellent printing quality can be obtained. In this embodiment, the substrate abutting portion 34*b* with the substrate abutting surfaces S1 is formed integrally with the base material portion 34*a* (i.e., the metal plate) having rigidity so that the substrate abutting surfaces S1 have high flatness within ±30 μm.

As described above, according to the first embodiment, the substrate abutting portion 34*b* (with the substrate abutting surfaces S1) of resin having insulation property is formed integrally with the base material portion 34*a* of metal having rigidity. Therefore, electrical insulation of the substrate 33 (i.e., electrical insulation between the substrate 33 and the lens holder 34) can be ensured. Further, the high straightness of the substrate 33 can be ensured, and therefore lights emitted by the LED array chip 31 can be accurately focused onto the surface of the photosensitive drum 13.

Further, unlike the prior art (i.e., Patent Document No. 1), the substrate 33 does not need to be covered with a thick resist layer. Therefore, the substrate 33 is less likely to be bruised during a mounting operation of the substrate 33 to the lens holder 34. Further, even if the resist layer is bruised, the electrical insulation of the substrate 33 is ensured by the substrate abutting portion 34*b* having insulation property.

Further, the substrate abutting portion 34*b* is formed so as to sandwich a part of the base material portion 34*a* (i.e., the metal plate) from opposing two sides (from above and from below) by causing the molten resin to flow via the holes T1 and the cutout portions T2 of the base material portion 34*a*. Therefore, the base material portion 34*a* and the substrate abutting portion 34*b*, which are made of different kinds of materials, can be formed integrally with each other.

Furthermore, the substrate abutting surfaces S1 of the lens holder 34 has the flatness within ±30 μm, and therefore the straightness of the LED array chip 31 mounted to the substrate 33 abutting against the substrate abutting surfaces S1 can be enhanced. As a result, the straightness of the linear image formed on the surface of the photosensitive drum 13 can be enhanced. In other words, a linear image can be accurately formed.

Second Embodiment

As was described in the first embodiment, the fixing device 28 of the printer 11 (FIG. 1) fixes a toner image (for example, a color image) to the printing sheet by application of heat and pressure. In this regard, a temperature of the fixing device 28 during the printing operation reaches 200° C. or more, and therefore environmental temperature of the LED head 15 may reach approximately 55° C. Therefore, the environmental temperature of the LED head 15 rises from a normal temperature (25° C.) by approximately 30° C. In the first embodiment, the substrate abutting portion 34*b* extends throughout the length of the elongated hole H1 of the base material portion 34*a*. However, since the substrate abutting portion 34*b* (resin) and the base material portion 34*a* (metal) have different linear expansion coefficients, it is necessary to suppress a deformation (more specifically, a warpage) of the lens holder 34 due to a bimetal effect.

In order to accurately focus the lights onto the surface of the photosensitive drum 13, it is necessary that the distance L11 from the surface of the LED array chip 31 to the incident surface of the rod lens array 32 is the same as the distance L12 from the exit surface of the rod lens array 32 to the surface of the photosensitive drum 13 (i.e., L11=L12) as described above. However, if the lens holder 34 is deformed, it is difficult to ensure the above described relationship (L11=L12). Therefore, in the second embodiment, the deformation of the lens holder 34 due to temperature change is suppressed as described below, in order to focus the lights onto the surface of the photosensitive drum 13 with high accuracy.

Figure 9:
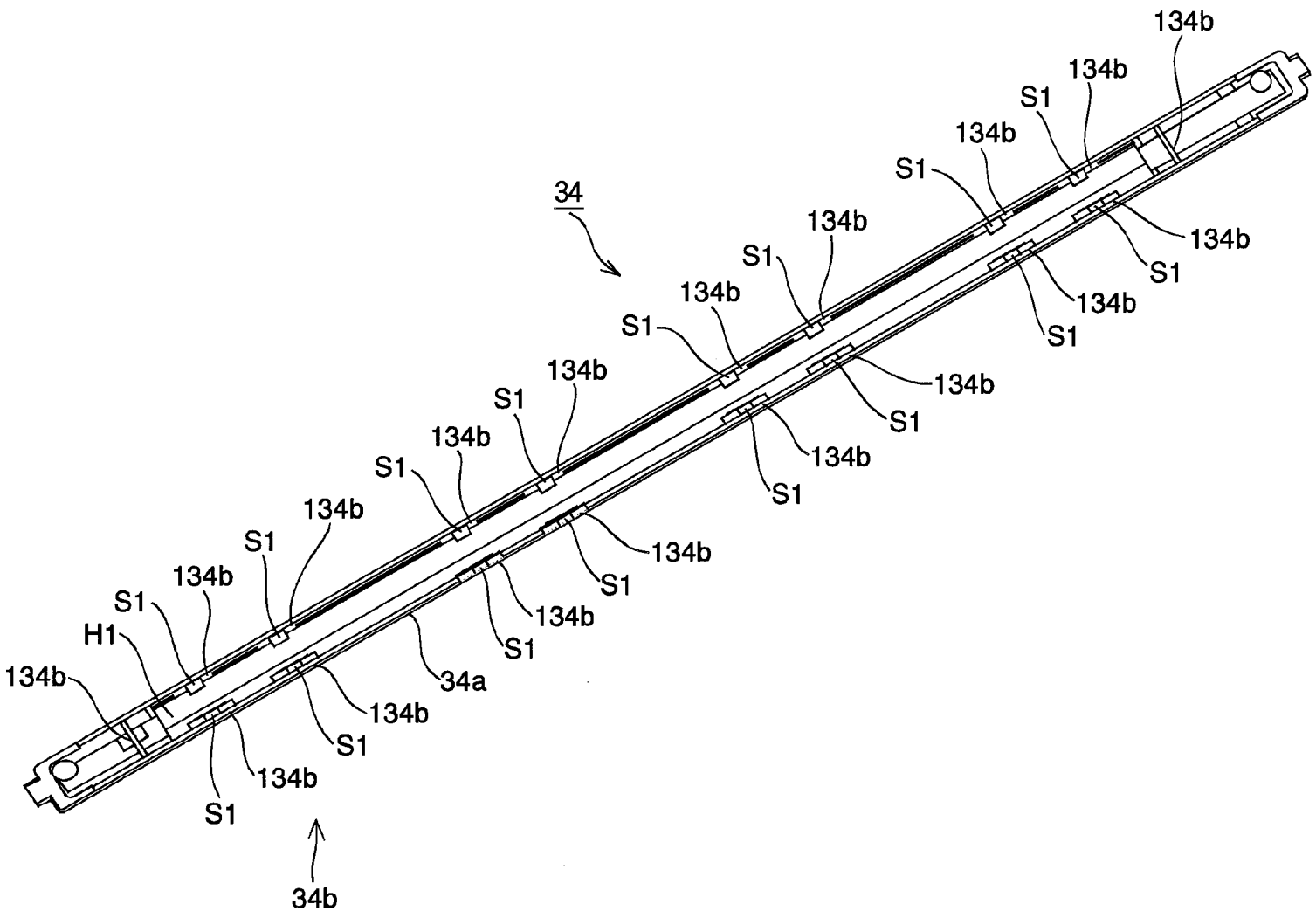
FIG. 9 is a plan view showing a lens holder of an LED head according to the second embodiment of the present invention.
Figure 10:
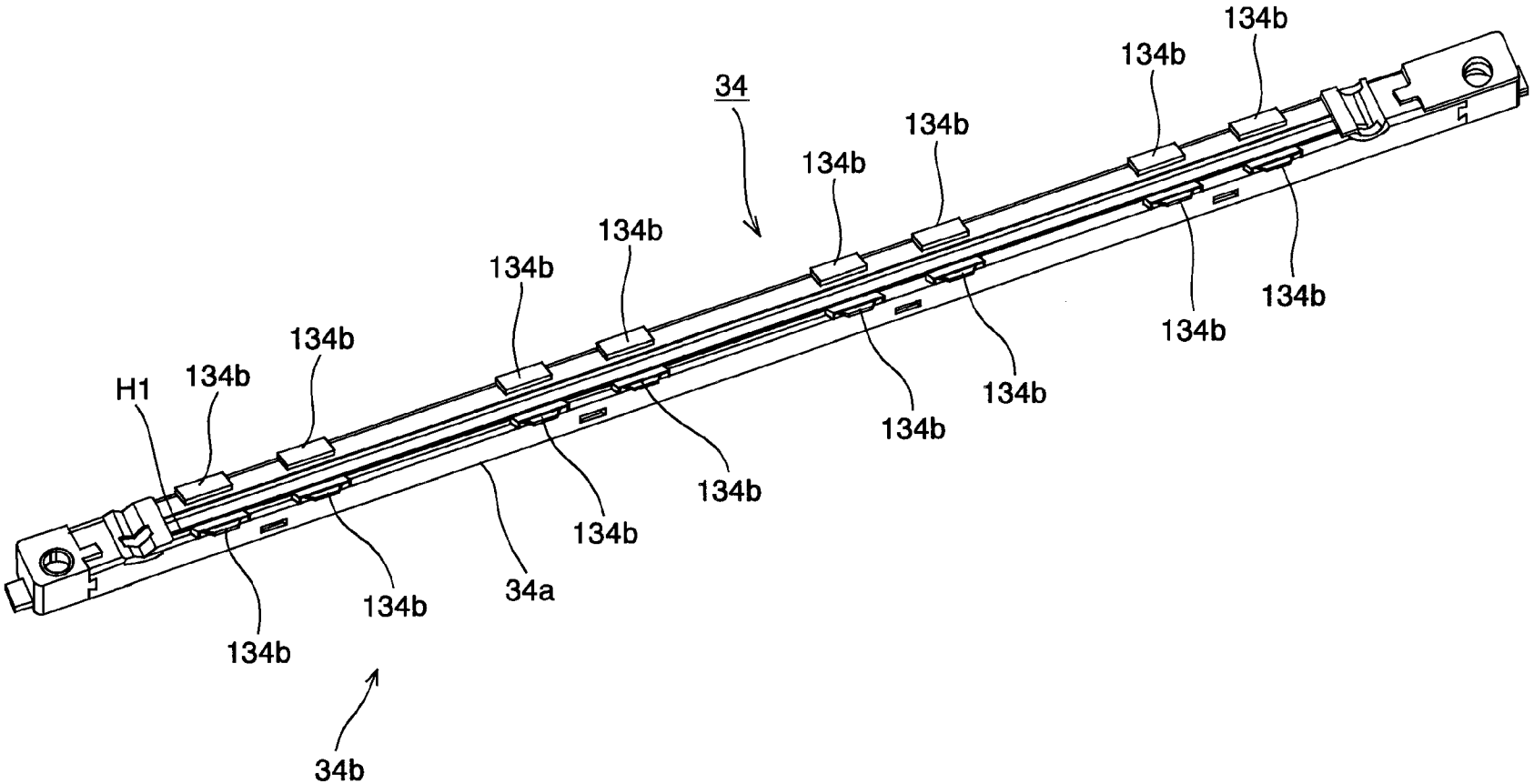
FIG. 10 is a bottom perspective view showing the lens holder according to the second embodiment of the present invention.
Figure 11:
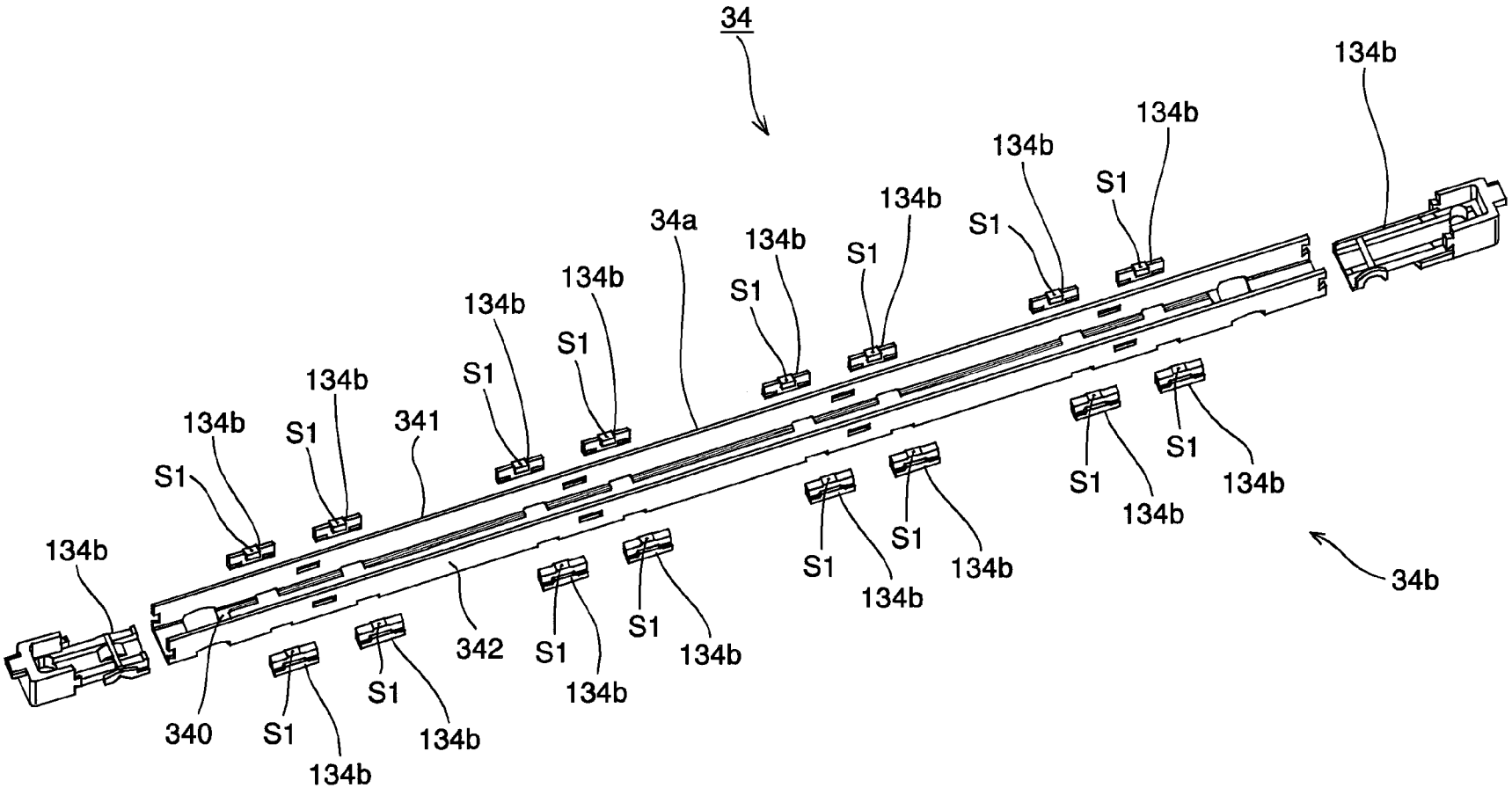
FIG. 11 is a top perspective view showing the lens holder according to the second embodiment of the present invention.
Figure 12:
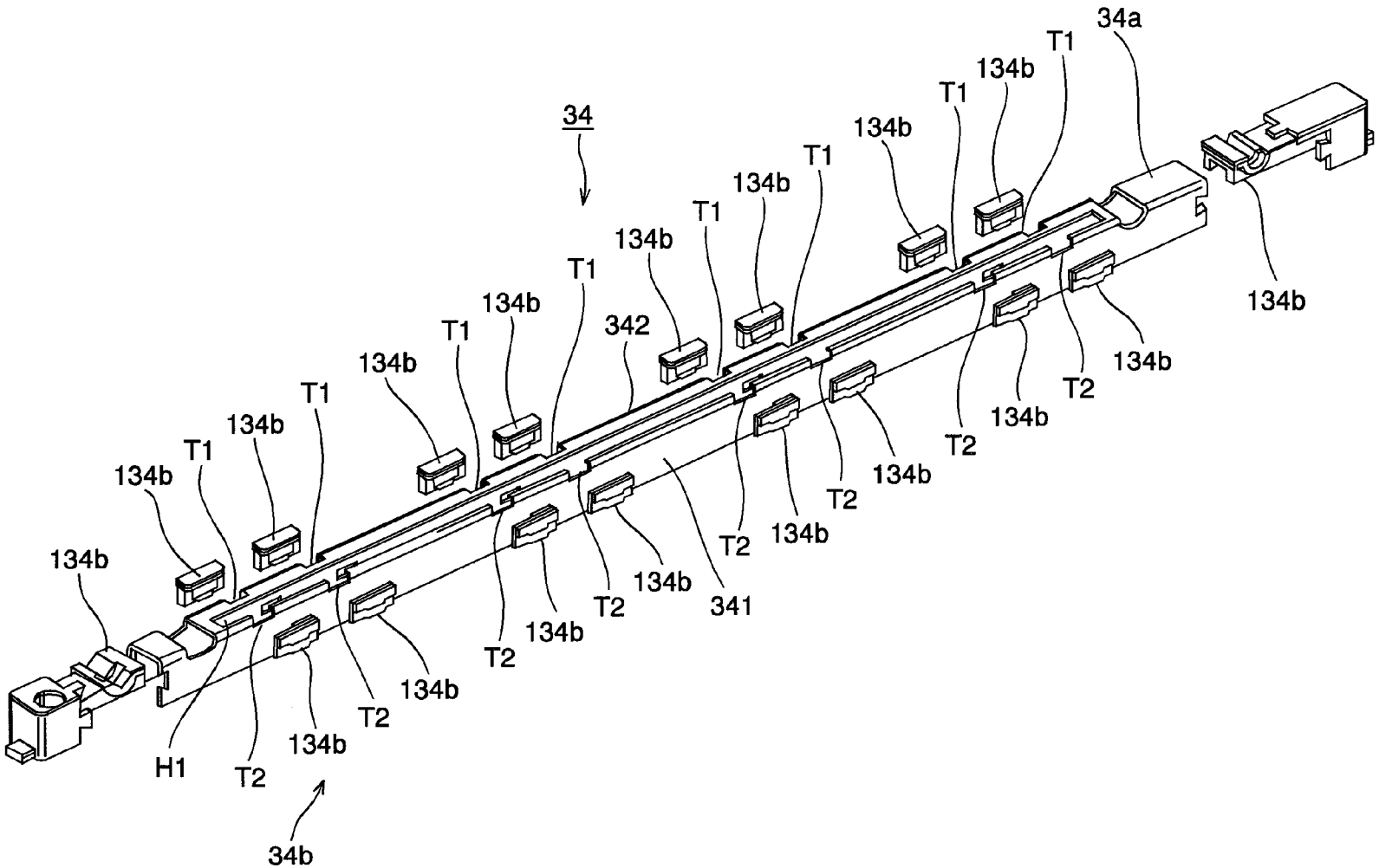
FIG. 12 is a bottom exploded perspective view showing the lens holder according to the second embodiment of the present invention.
Figure 13:
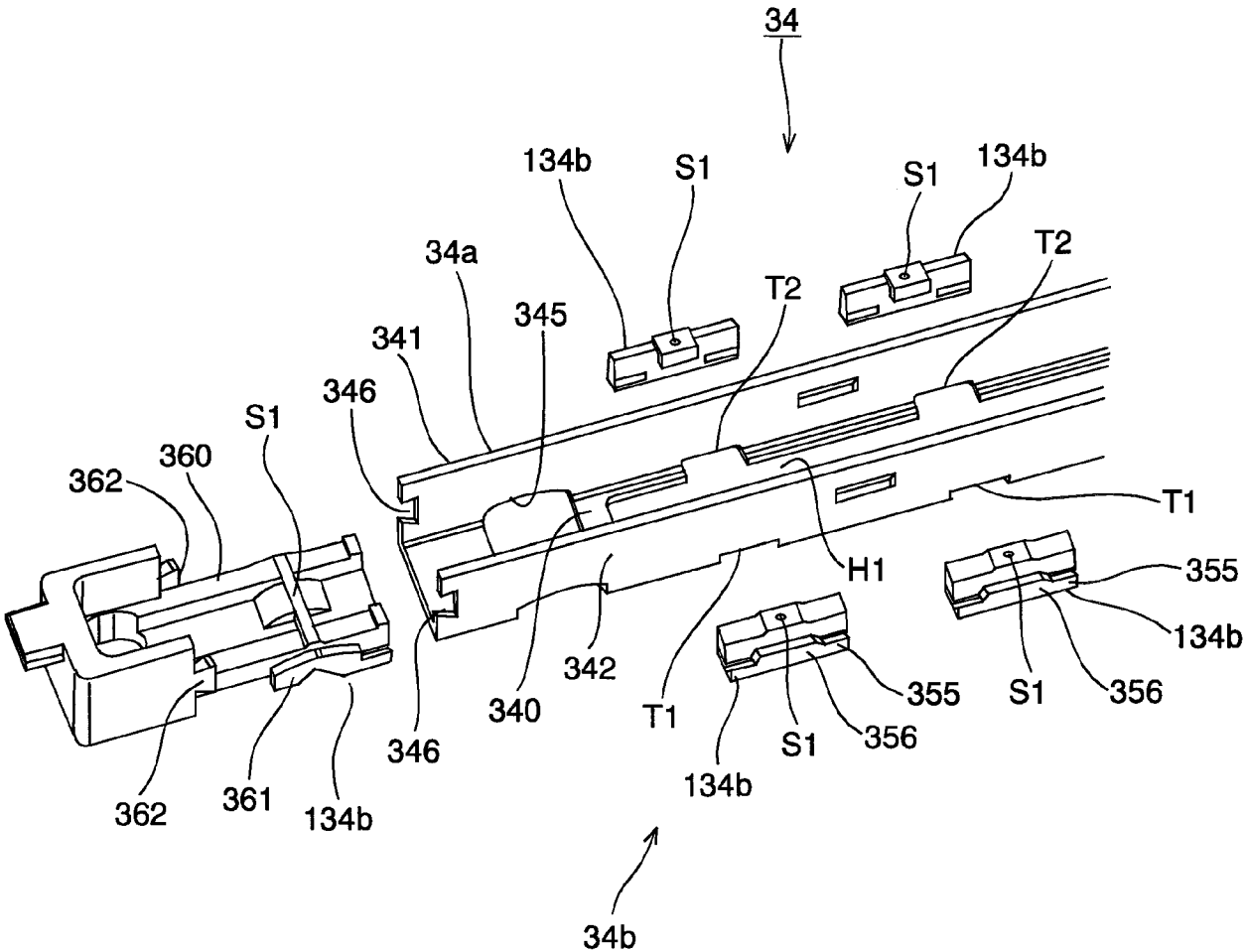
FIG. 13 is an enlarged view showing a part of the lens holder according to the second embodiment of the present invention.

FIG. 9 is a plan view showing the lens holder 34 according to the second embodiment of the present invention. FIG. 10 is a bottom perspective view showing the lens holder 34 according to the second embodiment of the present invention. FIGS. 11 and 12 are a top perspective view and a bottom exploded perspective view showing the lens holder 34 according to the second embodiment of the present invention. FIG. 13 is an enlarged view showing a part of the lens holder 34 according to the second embodiment of the present invention. In FIGS. 9 through 13, elements that are the same as those of the first embodiment will be assigned the same reference numerals.

As shown in FIGS. 9 through 13, the lens holder 34 includes a base material portion 34*a* that acts as a frame (or a body), and a substrate abutting portion 34*b* having substrate abutting surfaces S1 abutting against the substrate 33, as described in the first embodiment.

The base material portion 34*a* is made of metal (metal plate) so as to ensure rigidity of the lens holder 34. The substrate abutting portion 34*b* is made of resin having electrical insulation property. The substrate abutting portion 34*b* is preferably made of thermoplastic resin. The substrate abutting portion 34*b* is more preferably made of engineering plastic (for example, general-purpose engineering plastic). The lens holder 34 is integrally formed of a combination of different kinds of materials, i.e., the base material portion 34*a* (i.e., the metal plate) and the substrate abutting portions 34*b* (i.e., the resin).

As shown in FIGS. 11 to 13, the substrate abutting portion 34*b* of the second embodiment is divided into a plurality of sections 134*b* along the elongated hole H1 of the base material portion 34*a*. The divided sections will be referred to as the substrate abutting portions 134*b*. The base material portion 34*a* (the metal plate) is the same as that of the first embodiment.

The substrate abutting portions 134*b* have respective substrate abutting surfaces S1. The substrate abutting surfaces S1 are aligned on a same plane defining the position of the substrate 33 (on which the LED array chip 31 is mounted)

with respect to the rod lens array 32 and the photosensitive drum 13. Each substrate abutting portion 134*b* is formed by flowing molten resin via the hole T1 and the cutout portion T2 of the base material portion 34*a*, so that each substrate abutting portion 134*b* is formed so as to sandwich a part (i.e., a part including the bottom plate 340) of the base material portion 34*a* from above and from below (from two opposing sides).

To be more specific, as shown in FIG. 13, the respective substrate abutting portions 134*b* are in the form of plate-like pieces provided on inner sides of the side walls 341 and 342 of the base material portion 34*a*. In this regard, although the substrate abutting portions 134*b* are shown as being disposed outside the side walls 341 and 342 in FIG. 13 for convenience of illustration, the substrate abutting portions 134*b* are disposed inside the side walls 341 and 342. The substrate abutting surface S1 is formed on an upper surface of each substrate abutting portion 134*b*. Further, the substrate abutting portion 134*b* has an integrally formed bottom portion 355 and a convex portion 356. The bottom portion 355 mates with a bottom surface of the bottom plate 340 of the base material portion 34*a*, and the convex portion 356 mates with the hole T1 or the cutout portion T2 of the base material portion 34*a*.

Additional substrate abutting portions 134*b* are provided on both ends of the base material portion 34*a* in the longitudinal direction. Each of the substrate abutting portions 134*b* (on both ends of the base material portion 34*a*) has a pair of extending portions 360 extending along inner sides of the side walls 341 and 342 of the base material portion 34*a*. The substrate abutting surface S1 is formed so as to extend across between the extending portions 360 of the substrate abutting portion 134*b*. A pair of convex portions 361 are formed on the outer sides of the extending portions 360. The convex portions 361 engage cutout portions 345 formed on the bottom plate 340 and the side walls 341 and 342 of the base material portion 34*a*. Another pair of convex portions 362 are formed facing the end surfaces of the side walls 341 and 342 of the base material portion 34*a* in the longitudinal direction. The convex portions 362 engage cutout portions 346 formed on end surfaces of the side walls 341 and 342 of the base material portion 34*a*.

Figure 14:
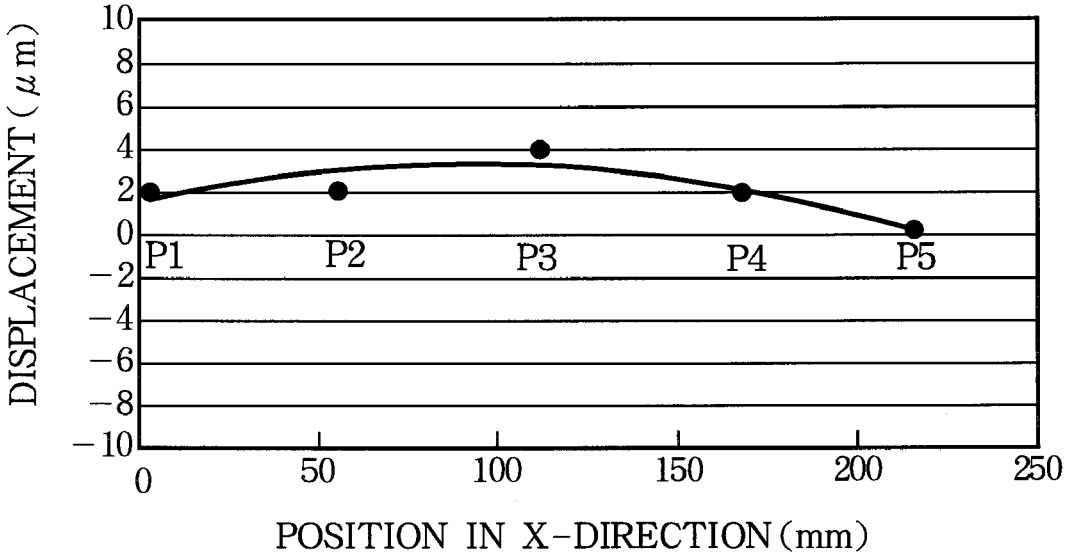
FIG. 14 is a graph showing measurement results of displacement of the lens holder due to change in environmental temperature, according to the second embodiment of the present invention.

FIG. 14 is a graph showing measurement results of displacement of the lens holder 34 when the environmental temperature changes from the normal temperature (25° C.) to the high temperature (55° C.). The direction of the displacement of the lens holder 34 (toward and away from the photosensitive drum 13) is expressed as Y direction. The longitudinal direction of the lens holder 34 is expressed as X direction.

Figure 15:
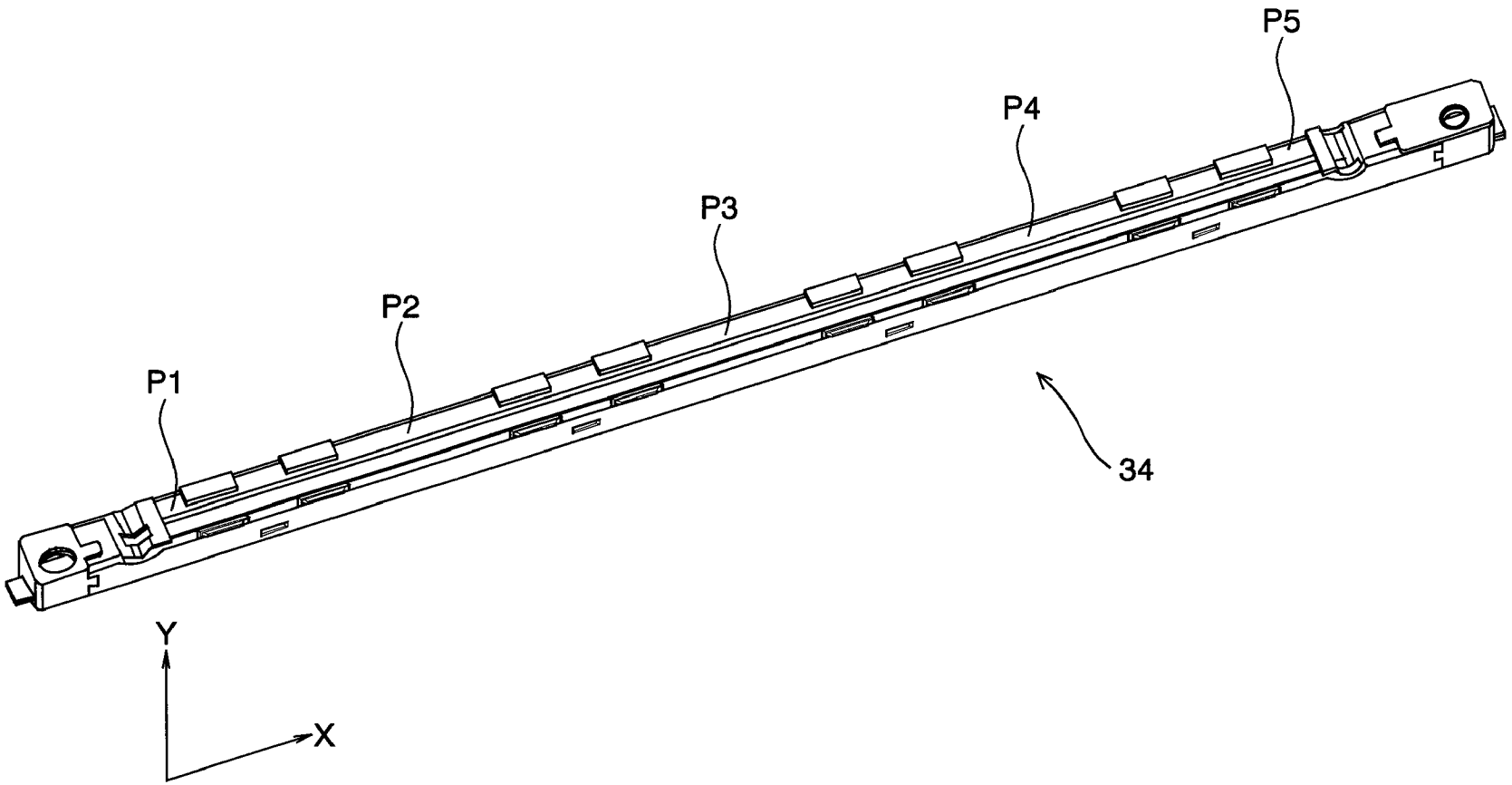
FIG. 15 is a perspective view for illustrating measurement positions of the displacement of the lens holder shown in FIG. 14.

FIG. 15 shows positions where the displacement of the lens holder 34 was measured. As shown in FIG. 15, the displacement of the lens holder 34 was measured at five positions P1, P2, P3, P4 and P5 along the longitudinal direction of the lens holder 34 (i.e., X direction) at substantially constant intervals. The position P1 (mm) in the X direction is set to 0 (zero). The positions P2, P3, P4 and P5 (mm) in the X direction are as shown in FIG. 15. The displacement of the lens holder 34 is expressed as a positive value when the lens holder 34 is displaced toward the photosensitive drum 13 (i.e., displaced downward).

In the experiment, the base material portion 34*a* was made of an electrogalvanized steel plate, and a thermal expansion coefficient thereof was $1.17\times10^{-5}$/° C. The substrate abutting portion 134*b* having the substrate abutting surface S1 was made of thermoplastic liquid crystal polymer, and a thermal expansion coefficient thereof was $0.5\times10^{-5}$/° C. (in a flow direction) and $5.5\times10^{-5}$/° C. (in a transverse direction). The base material portion 34*a* and the substrate abutting portion 134*b* were formed integrally with each other to form the lens holder 34.

As shown in FIG. 14, at a temperature of 55° C. (i.e., a possible temperature in the printing operation), the warpage of the lens holder 34 toward the lens holder 34 of approximately 4 μm occurs. As described in the first embodiment, the excellent printing quality can be obtained when the variation of the distance L12 from the exit surface of the rod lens array 32 to the surface of the photosensitive drum 13 is within ±10 μm. Therefore, the warpage (4 μm) of the lens holder 34 is sufficient in obtaining the excellent printing quality. Thus, the excellent printing quality can be obtained even when the environmental temperature is 55° C.

As described above, according to the second embodiment of the present invention, a plurality of substrate abutting portions 134*b* are provided along the elongated hole H1 of the base material portion 34*a* at intervals, and each substrate abutting portion 134*b* has the substrate abutting surface S1. Therefore, although the lens holder 34 is formed of a combination of the base material portion 34*a* and the substrate abutting portions 134*b*, which are different kinds of materials having different thermal expansion coefficients, the deflection of the lens holder 34 due to temperature change (i.e., due to the bimetal effect) is suppressed. Thus, the distance L11 from the surface of the LED array chip 31 to the incident surface of the rod lens array 32 and the distance L12 from the exit surface of the rod lens array 32 to the surface of the photosensitive drum 13 can be kept the same as each other. As a result, the exposing device 15 can perform exposure with high accuracy, and the image forming apparatus 11 can form a high quality image.

In the above described first and second embodiments, the substrate abutting portion 34*b* (134*b*) has the holes T1 on one side (i.e., right in FIG. 8) and the cutout portions T2 on the other side (i.e., left in FIG. 8). However, it is also possible that the substrate abutting portion 34*b* (134*b*) has holes T1 on both sides, or has cutout portions T2 on both sides.

Further, it is also possible that the substrate abutting portion 34*b* (134*b*) has the holes T1 or the cutout portions T2 on only one side (i.e., right side or left side) of the substrate abutting portion 34*b*.

In the above described first and second embodiments, the substrate abutting portion 34*b* (134*b*) is preferably made of thermoplastic resin, and more preferably made of engineering plastic. However, it goes without saying that the substrate abutting portion 34*b* (134*b*) can be made of resin other than engineering plastic. Alternatively, the substrate abutting portion 34*b* (134*b*) can also be formed of thermosetting resin in the case where the substrate abutting portion 34*b* (134*b*) can be formed integrally with the base material portion 34*a*. In this regard, forming the substrate abutting portion 34*b* (134*b*) of thermoplastic resin is advantageous in that the substrate abutting portion 34*b* (134*b*) can easily be formed integrally with the base material portion 34*a* by flowing the molten resin via the holes T1 or the cutout portions T2.

While the preferred embodiments of the present invention have been illustrated in detail, it should be apparent that modifications and improvements may be made to the invention without departing from the spirit and scope of the invention as described in the following claims.

What is claimed is:

1. An exposing device comprising:

a plurality of light emitting elements;

a substrate to which said plurality of light emitting elements are mounted;

an optical system that focuses lights emitted by said plurality of light emitting elements, and a holder that holds said optical system, said holder having a one-piece structure, wherein said holder includes:

a base material portion made of metal;

a substrate abutting portion fixed to said base material portion by being formed integrally with said base material portion, said substrate abutting portion being made of resin having electrical insulation property; and a substrate abutting surface formed on said substrate abutting portion, said substrate abutting surface abutting against said substrate.

2. The exposing device according to claim 1, wherein said substrate abutting portion of said holder is formed of thermoplastic resin.

3. The exposing device according to claim 1, wherein said substrate abutting portion of said holder is formed of engineering plastic.

4. The exposing device according to claim 1, wherein said substrate abutting portion of said holder is formed integrally with said base material portion using an outsert forming method.

5. The exposing device according to claim 1, wherein said substrate abutting portion is formed to sandwich a part of said base material portion from two opposing sides.

6. The exposing device according to claim 1, wherein said substrate abutting portion of said holder is formed by flowing a molten resin via a hole or a cutout portion formed on said part of said base material portion.

7. The exposing device according to claim 6, wherein said base material portion of said holder has an elongated opening for storing said optical system therein, and wherein said hole or cutout portion is formed on at least one side of said elongated opening.

8. The exposing device according to claim 1, wherein said substrate has an elongated shape, and said plurality of light emitting elements are arranged in a longitudinal direction of said substrate, and wherein a plurality of said substrate abutting portions are arranged in said longitudinal direction of said substrate.

9. The exposing device according to claim 1, wherein said substrate abutting surface of said substrate abutting portion has flatness within ±30μm.

10. The exposing device according to claim 1, further comprising:

a pushing member that contacts a surface of said substrate facing away from said substrate abutting surface, and a biasing member that biases said pushing member against said substrate abutting surface.

11. An image forming apparatus comprising:

said exposing device according to claim 1, and a latent image bearing body exposed by said exposing device to form a latent image thereon.

* * * * *